United States Patent [19]

Badzinski et al.

[11] 4,389,199

[45] Jun. 21, 1983

[54] SHAFT LOCK FOR PROPELLERS FOR SAILING BOATS

[75] Inventors: Richard D. Badzinski, Oak Creek; George G. Nigel, St. Francis, both of Wis.

[73] Assignee: Shaft Lok Inc., New Berlin, Wis.

[21] Appl. No.: 299,397

[22] Filed: Sep. 4, 1981

[51] Int. Cl.[3] ..... B63H 5/06

[52] U.S. Cl. ..... 440/74; 440/83

[58] Field of Search ..... 440/74, 83, 111, 112; 74/527; 188/69, 72.1, 31

[56] References Cited

U.S. PATENT DOCUMENTS

| | | | |
|---|---|---|---|
| 278,182 | 5/1883 | Reynolds | 440/74 |
| 831,745 | 9/1906 | Rice | 74/257 |
| 974,961 | 11/1910 | Hall | 440/74 |
| 2,124,497 | 7/1938 | Slavson | 440/74 |
| 2,317,344 | 5/1943 | Hood | 188/69 |
| 2,486,672 | 11/1949 | Nofestem | 188/69 |
| 3,183,739 | 5/1965 | Rajewski | 74/527 |
| 3,476,072 | 11/1969 | Wilson | 440/74 |
| 3,786,775 | 1/1974 | Sarns | 440/74 |
| 3,831,547 | 8/1974 | Bird | 440/74 |

*Primary Examiner*—Trygve M. Blix
*Assistant Examiner*—Stephen P. Avila
*Attorney, Agent, or Firm*—Shlesinger, Arkwright, Garvey & Dinsmore

[57] ABSTRACT

An auxiliary engine propeller shaft locking device for sail boats and the like comprising, a base having an upper lock housing and a lower shaft housing; the housings being integral and in substantially abutting relation with each other. The shaft housing includes a rotatable propeller shaft disc mounted thereon having an inner and outer surface. The housings have front and back surfaces, with the shaft disc mounted on the shaft housing front surface, and the lock housing front surface being above the shaft housing front surface. The disc outer surface is below the plane of the front lock housing surface and the disc inner surface is above the plane of the shaft housing front surface to provide rotating clearance for the disc. The shaft disc has a width less than the width of the shaft housing to provide rotating clearance for the disc. The lock housing includes a locking pin and a shot pin for the locking pin, and the disc includes locking pin engaging means. The locking pin has means for receiving the shot pin including a first disc lock position means and a second disc release position means. The lock housing includes means for moving the locking pin from lock position to the release position and from the release position to the lock position.

16 Claims, 3 Drawing Figures

SHAFT LOCK FOR PROPELLERS FOR SAILING BOATS

This invention relates to a shaft locking device and more particularly to a propeller shaft locking device having a rotatably moving propeller shaft disc which is engageable with a locking pin and is manually engaged and there is no need to manually disengage in fact we recommend against this procedure, simply start engine and engage transmission to disengage unit.

HISTORICAL BACKGROUND

A common problem with sail boats provided with an auxiliary engine is the movement of the propeller and shaft while the sail boat is under sail. This effect, known as windmilling, creates a number of problems. The movement of the propeller and shaft creates unnecessary wear and damage to the transmission, coupling and shaft bearings. The rotating shaft creates a loud and irritating noise to those on board. Also the speed of the vessel while under sail is decreased anywhere from 5 to 15 percent when the shaft is allowed to rotate rapidly and creates drag. By locking the shaft and positioning the propeller behind the keel or "dead wood", the drag is effectively eliminated. Prior propeller shaft locking devices as in U.S. Pat. Nos. 3,831,547 and 3,786,775 are either complicated devices, difficult to install, or both.

OBJECTS AND SUMMARY

It is, therefore, an object of the present invention to provide a propeller shaft locking device which is easily and quickly installed requiring no electrical, hydraulic or complicated mechanical equipment to operate and which positively locks and positions the propeller and shaft behind the keel eliminating the drag from a freely rotating propeller.

It is another object of this invention to prevent unnecessary wear and damage to the transmission, coupling and shaft bearings.

A further object of this invention is to eliminate the loud and irritating noise from a freely rotating propeller and shaft.

An additional object of this invention is to provide automatic disengagement when the engine is started and transmission is put into gear.

Another object of this invention is to provide a minimum amount of moving parts while maintaining high efficiency and low maintenance.

To summarize this invention, it relates to a propeller shaft locking device which is manually engageable and automatically disengageable to provide effective stationary positioning of the propeller blades.

These and other objects of this invention will be apparent from the following description and claims.

DESCRIPTION OF THE DRAWINGS

In the accompanying drawings which illustrate by way of example various embodiments of this invention.

DETAILED DESCRIPTION OF DRAWINGS

Figure 1:
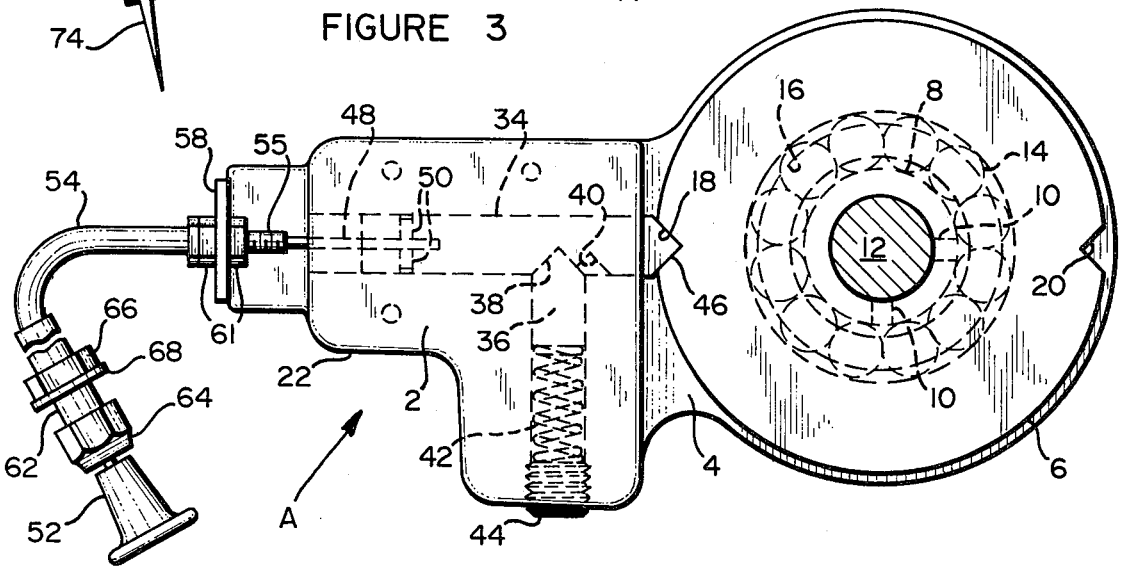
FIG. 1 is a fragmentary front elevational view of the shaft locking device portions being shown in hidden lines.
Figure 2:
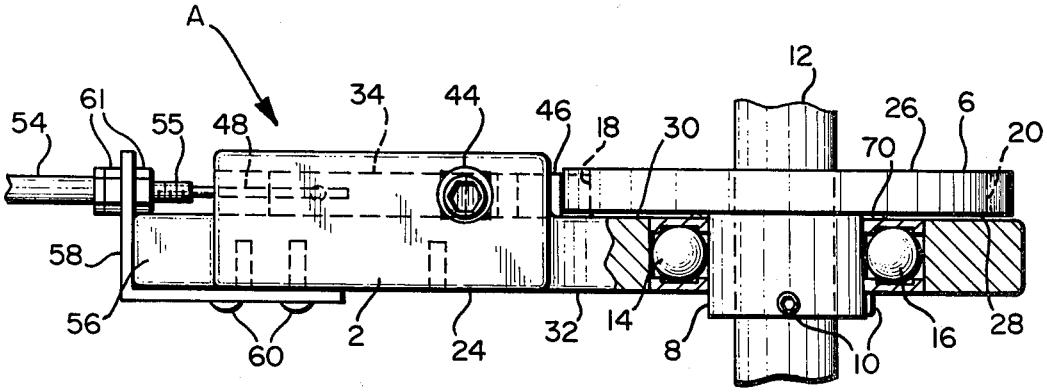
FIG. 2 is a side elevational fragmentary view of the shaft locking device portions being shown in hidden lines.

Referring now to FIGS. 1 and 2, the base portion A is formed from an upper lock housing 2 and a lower shaft housing 4. The housings 2 and 4 are integral and in substantially abutting relation with each other. Mounted on the shaft housing 4 is the shaft disc 6, rotatably movable thereon. The disc 6 includes a shaft collar 8 and shaft collar lock screws 10. The propeller shaft 12 mounts and locks within the shaft collar 8. Means for disc 8 movement, includes double shielded ball bearings 14 in ball bearing race 16 within the disc 6. Located in the edge of disc 6 are shaft disc notches 18 and 20, at a distance 180° relative to each other.

The lock housing 2, has a front lock housing portion 22, as well as a back lock housing portion 24. The shaft disc 6, has both an outer surface 26 and an inner surface 28. Also, the shaft housing 4, has outer surface 30, and inner surface 32.

When disc 6 is mounted on shaft housing 4 the disc outer surface 26 lies below the front lock housing portion 22 and above the shaft housing portions outer surface 30.

The lock housing portion 2 and includes a lock pin 34 and a shot pin 36. The shot pin 36 is engageable with the lock pin 34 at upper notch 38 and lower notch 40. Spring 42 is engageable with shot pin 36 and adjusted by adjustment screw 44. The lock pin 34 also includes a point 46 engageable with shaft disc notches 18 and 20. Cable 48 is attached to lock pin 34 by set screws 50. It is also attached to engagement knob 52. Cable 48 is shielded by sleeve 54 having a threaded ferrule 55. Cable 48 is mounted to base A at flange 56 by bracket 58 and screws 60. Lock nuts 61 threaded on ferrule 55 position the cable 48.

Mounting means also exits for engagement knob 52 including outer sleeve 62 lock nut 64, 66 and washer 68.

Surrounding shaft collar 8 and lying between disc inner surface 28 and housing outer surface 30 is C-clip or washer 70 providing rotatable clearance between disc inner surface 28 and housing outer surface 30.

Figure 3:
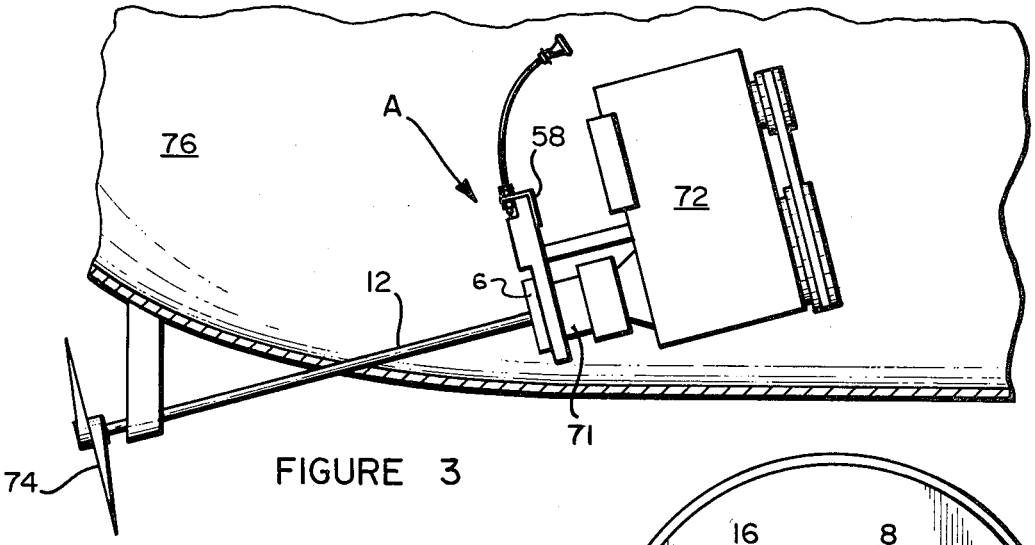
FIG. 3 is a fragmentary side elevation of a boat showing the shaft locking device attached to the auxiliary boat engine in schematic form.

FIG. 3 illustrates the attachment of shaft locking device A to propeller shaft 12 just aft of engine coupling 71, of with perspective view of shaft 12 and propeller 74.

OPERATION

FIGS. 1 and 2 illustrate the locking device in the engaged position. The shaft 6 is held in position at notch 18 of the two notches 18 and 20 by the lock pin point 46. The notches 18, 20 are previously, during installation, placed in line with the propeller blade 74. Hence, when the locking device A is in the lock position, the propeller 74 is in the desired place.

The locking device A can be disengaged automatically when the engine 72 has been started. Placing the engine's transmission in forward or reverse will turn the propeller shaft 12 and consequentially the shaft disc 6. The resultant torque on the shaft disc 6 is greater than the static holding power of the lock pin 34 whose position is held by spring actuated shot pin 36. The shot pin 36 located in the lock position is at the first upper notch 38 on the lock pin 34. Although the engine torque is sufficient to disengage the shaft lock pin 34 from the lock position, the tension provided upon shot pin 36 by spring 42 is sufficient enough to provide holding power to prevent water from moving the propeller 74 when the vessel is moved by other means, i.e. the vessel is under sail. The tension on shot pin 36 is regulated by the adjustment screw 44.

Once disengaged, the shot pin 36 now occupies lower notch 40 on lock pin 34. Spring tension on shot pin 36 maintains contact with shot pin 34 lower notch 40 and hence retains lock pin 34 in disengaged position. The distance between upper notch 38 and lower notch 40 on lock pin 34 is greater than the depth of shaft disc notches 18, 20. Hence, rotating clearance of the shaft disc 6 and shaft 12 is permitted.

The shaft 12 is slid through the shaft collar 8 and is secured to the shaft collar 8 by lock screws 10. The shaft disc collar 8 is fitted within the ball bearing race 16 of the shaft housing 4. The race 16 contains double shielded ball bearings 14 and allows rotatable movement of the collar 8 and shaft disc 6. A C-clip or washer 70, is placed between the shaft disc inner surface 28 and the outer surface of the ball bearing race 17. This positioning of the C-clip or washer 70 provides clearance of the shaft disc 6 from the shaft housing portion 4 and free movement therearound.

The locking device A can be reengaged manually by pushing in the handle 52 while the shaft 12 and shaft disc 6 is slowly turning due to water drag against the propeller 74. The downward movement on handle 52 pushes cable 48 and therefore locking pin 34 against the turning shaft disc 6. Locking pin point 36 will then engage notch 18 or 20 on shaft disc 6. The disc 6 and the shaft 12 are now locked. The pressure from spring 42 upon shot pin 36 is such that movement from the disengaged position lower notch 40 to the engaged position upper notch 38 is easily accomplished.

While this invention has been described as having a preferred design, it will be understood that it is capable of further modification. This application, is therefore, intended to cover any variations, uses, or adaptations of the invention following the general principles thereof and including such departures from the present disclosure as come within known or customary practice in the art to which this invention pertains, and as may be applied to the essential features hereinbefore set forth and fall within the scope of this invention or the limits of the claims.

What is claimed is:

1. An auxiliary engine propeller shaft locking device for sailboats and the like comprising:

(a) a base having an upper lock housing and a lower shaft housing (b) said housings being integral (c) said shaft housing inclining an aperture therethrough (d) said housings having front and back surfaces (e) a shaft disc rotatable on an axis and said disc mounted in said aperture (f) said lock housing front surface extending beyond said shaft housing front surface (g) said lock housing surface extending beyond said disc's outer surface and said disc's inner surface being adjacent the plane of said shaft housings front surface to provide rotating clearance for said disc (h) said shaft disk having a width less than the width of said shaft housing to provide rotating clearance for said disc (i) said lock housing including a locking pin and a shot pin for said locking pin, said locking pin positioned transverse of said axis (j) said disc including locking pin engaging means (k) said locking pin having means for receiving said shot pin including first disc lock position means and said second disc release position means, and (l) means for moving said locking pin from lock position to said release position and from said release position to said lock position.

2. An auxiliary engine propeller shaft locking device as in claim 1 and wherein:

(a) said lock housing is L-shaped.

3. An auxiliary engine propeller shaft locking device as in claim 1, and wherein:

(a) said shaft housing is of circular shape.

4. An auxiliary engine propeller shaft locking device as in claim 1, and wherein:

(a) said housing back surfaces are coplaner.

5. An auxiliary engine propeller shaft locking device as in claim 1, and wherein:

(a) said shaft disc includes a shaft collar.

6. An auxiliary engine propeller shaft locking device as in claim 1, and wherein:

(a) said lock housing has a thickness greater than that of said shaft housing.

7. An auxiliary engine propeller shaft locking device as in claim 1 and wherein:

(a) said locking pin is movably mounted in the vertical leg of said L-shaped lock housing.

8. An auxiliary engine propeller shaft locking device as in claim 1, and wherein:

(a) said shot pin is movably mounted in the horizontal leg of said L-shaped lock housing and engageable transversely with said locking pin.

9. An auxiliary engine propeller shaft locking device as in claim 1, and wherein:

(a) said means for moving said locking pin includes a control cable movable to move said locking pin from said release position to said lock position and from said lock portion to said release portion, respectively.

10. An auxiliary engine propeller shaft locking device as in claim 9, and wherein:

(a) said base member includes a support flange extending from said L-shaped lock housing for supporting said control cable.

11. An auxiliary engine propeller shaft locking device as in claim 1, and wherein:

(a) said shot pin is spring biased.

12. An auxiliary engine propeller shaft locking device as in claim 1, and wherein:

(a) said base member includes and adjustment screw and a compression spring in the horizontal leg of the L-shaped lock housing for adjusting the pressure on said shot pin.

13. An auxiliary engine propeller shaft locking device as in claim 1, and wherein:

(a) said locking pin means for receiving said shot pin at said first disc lock portion consisting of upper and lower shot pin notches.

14. An auxiliary engine propeller shaft locking device as in claim 9 and wherein:

(a) said control cable is extensive with said disc locking pin engaging means.

15. An auxiliary engine propeller shaft locking device as in claim 5 and wherein:

(a) said shaft housing includes a ball bearing sleeve within which shaft collar is rotatably movable.

16. An auxiliary engine propeller shaft locking device as in claim 1, wherein:

(a) said disc being annular in shape; and, (b) said locking pin engaging means being located substantially at said disc's periphery.

* * * * *

UNITED STATES PATENT AND TRADEMARK OFFICE

CERTIFICATE OF CORRECTION

PATENT NO. : 4,389,199

DATED : June 21, 1983

INVENTOR(S) : RICHARD D. BADZINSKI and GEORGE G. NIGEL

It is certified that error appears in the above-identified patent and that said Letters Patent is hereby corrected as shown below:

Claim 1, Line 51, wherein "inclining" should read "including"

Signed and Sealed this

*Eleventh* Day of *October 1983*

[SEAL]

*Attest:*

GERALD J. MOSSINGHOFF

*Attesting Officer* *Commissioner of Patents and Trademarks*